US005306126A

United States Patent [19]

Richardson, Jr.

[11] Patent Number: 5,306,126

[45] Date of Patent: Apr. 26, 1994

[54] SCROLL COMPRESSOR LUBRICATION CONTROL

[75] Inventor: Hubert Richardson, Jr., Brooklyn, Mich.

[73] Assignee: Tecumseh Products Company, Tecumseh, Mich.

[21] Appl. No.: 916,598

[22] Filed: Jul. 20, 1992

Related U.S. Application Data

[63] Continuation-in-part of Ser. No. 675,641, Mar. 27, 1991, Pat. No. 5,131,828.

[51] Int. Cl.[5] ..... F04C 18/04; F04C 27/00; F04C 29/02

[52] U.S. Cl. ..... 418/1; 418/55.4; 418/55.5; 418/55.6; 418/100

[58] Field of Search ..... 418/1, 55.4, 55.5, 55.6, 418/57, 94, 100

[56] References Cited

U.S. PATENT DOCUMENTS

| | | | |
|---|---|---|---|
| 4,350,479 | 9/1982 | Tojo et al. | 418/55.6 |
| 4,522,575 | 6/1985 | Tischer et al. | 418/55.5 |
| 4,762,477 | 8/1988 | Hayano et al. | 418/1 |
| 4,767,293 | 8/1988 | Caillat et al. | 418/55.5 |
| 4,875,838 | 10/1989 | Richardson, Jr. | 418/55.6 |
| 4,884,955 | 12/1989 | Richardson, Jr. | 418/1 |
| 4,997,349 | 3/1991 | Richardson, Jr. | 418/55.5 |

FOREIGN PATENT DOCUMENTS

| | | | |
|---|---|---|---|
| 0348601 | 1/1990 | European Pat. Off. . | |
| 3422389 | 12/1984 | Fed. Rep. of Germany . | |
| 60-224988 | 11/1985 | Japan | 418/55.4 |
| 62-168986 | 7/1987 | Japan . | |
| 62-178791 | 8/1987 | Japan . | |
| 62-214289 | 9/1987 | Japan . | |
| 173617 | 11/1991 | Taiwan . | |
| 176965 | 1/1992 | Taiwan . | |
| 126778 | 3/1992 | Taiwan . | |

*Primary Examiner*—John J. Vrablik
*Attorney, Agent, or Firm*—Baker & Daniels

[57] ABSTRACT

A hermetic scroll-type compressor including a housing, fixed and orbiting scroll members, a frame member having a thrust surface adjacent the orbiting scroll member back surface, and a crankshaft coupled to the orbiting scroll member. A seal between the thrust surface and the back surface of the orbiting scroll member seals between a radially inner portion of the back surface exposed to discharge pressure and a radially outer portion exposed to suction pressure. The frame member defines an annular oil chamber having a side surface and a bottom surface above which the radially outer portion of the back surface orbits in spaced relationship. The oil chamber contains a sufficient depth of oil to extend the oil level above an upper peripheral edge of the orbiting scroll member, whereby oil from the oil chamber is sucked between the intermeshed scroll members. Radial compliance of the orbiting scroll meters the oil flow between the scroll members.

9 Claims, 5 Drawing Sheets

SCROLL COMPRESSOR LUBRICATION CONTROL

This is a continuation-in-part of U.S. application Ser. No. 07/675,641 filed Mar. 27, 1991, that has become U.S. Pat. No. 5,131,828.

BACKGROUND OF THE INVENTION

The present invention relates generally to a hermetic scroll-type compressor including intermeshing fixed and orbiting scroll members and, more particularly, to such a compressor having an oil lubrication control mechanism that acts to control the leakage between the orbiting and fixed scroll members during compressor operation.

A typical scroll compressor comprises two facing scroll members, each having an involute wrap, wherein the respective wraps interfit to define a plurality of closed compression pockets. When one of the scroll members is orbited relative to the other, the pockets decrease in volume as they travel between a radially outer suction port and a radially inner discharge port, thereby conveying and compressing the refrigerant fluid.

It is generally believed that the scroll-type compressor could potentially offer quiet, efficient, and low-maintenance operation in a variety of refrigeration system applications. However, several design problems persist that have prevented the scroll compressor from achieving wide market acceptance and commercial success. For instance, during compressor operation, the pressure of compressed refrigerant at the interface between the scroll members tends to force the scroll members axially apart. Axial separation of the scroll members causes the closed pockets to leak at the interface between the wrap tips of one scroll member and the face surface of the opposite scroll member. Such leakage causes reduced compressor operating efficiency and, in extreme cases, can result in an inability of the compressor to operate.

Leakage at the tip-to-face interface between scroll members during compressor operation can also be caused by a tilting and/or wobbling motion of the orbiting scroll member. This tilting motion is the result of overturning moments generated by forces acting on the orbiting scroll at axially spaced locations thereof. Specifically, the drive force imparted by the crank-shaft to the drive hub of the orbiting scroll is spaced axially from forces acting on the scroll wrap due to pressure, inertia, and friction. The overturning moment acting on the orbiting scroll member causes it to orbit in a slightly tilted condition so that the lower surface of the plate portion of the orbiting scroll is inclined upwardly in the direction of the orbiting motion. Wobbling motion of the orbiting scroll may result from the interaction between convex mating surfaces, particularly during the initial run-in period of the compressor. For instance, the mating wrap tip surface of one scroll member and face plate of the other scroll member may exhibit respective convex shapes due to machining variations and/or pressure and heat distortion during compressor operation. This creates a high contact point between the scroll members, about which the orbiting scroll has a tendency to wobble until the parts wear in. The wobbling perturbation occurs on top of the tilted orbiting motion described above.

Further, present scroll compressors of either low side or intermediate designs separate oil out of the compressor before the oil impacts the scroll set (the set of the orbiting and fixed scroll members). Inadequate lubrication of the scrolls permits refrigerant leakage between the scroll wraps and thereby loss of compressor effi7 ciency. Adequate lubrication of the scroll set is necessary during the run-in of the scrolls as well as during normal operation.

Efforts to counteract the separating force applied to the scroll members during compressor operation, and thereby minimize the aforementioned leakage, have resulted in the development of a variety of prior art axial compliance schemes. In a compressor in which the back side of the orbiting scroll member is exposed to suction pressure, it is known to axially preload the scroll members toward each other with a force sufficient to resist the dynamic separating force. However, this approach results in high initial frictional forces between the scroll members and/or bearings when the compressor is at rest, thereby causing difficulty during compressor startup and subsequent increased power consumption. Another approach is to assure close manufacturing tolerances for component parts and have the separating force borne by a thrust bearing or surface. This requires an expensive thrust bearing, and involves high manufacturing costs in maintaining close machining tolerances.

The present invention is directed to overcoming the aforementioned problems associated with scroll-type compressors, wherein it is desired to provide an oil control mechanism that helps to prevent leakage between the interfitting scroll members.

SUMMARY OF THE INVENTION

The present invention overcomes the disadvantages of the above-described prior art scroll-type compressors by providing an oil control mechanism that resists leakage from between the scroll wraps.

Generally, the invention provides a scroll-type compressor including a fixed scroll member and an orbiting scroll member that ar biased toward one another by an axial compliance mechanism. The drive mechanism by which the orbiting scroll member is orbited relative the fixed scroll member has a tendency to cause a tilting and wobbling motion of the orbiting scroll member during compressor operation. The axial compliance mechanism involves the application of discharge pressure to a radially inner portion of the back surface of the orbiting scroll member and suction pressure to a radially outer portion of the back surface. Furthermore, an oil pool is provided adjacent the radially outer portion of the back surface of the orbiting scroll member, whereby a reactionary force is exerted by the oil upon the back surface in response to the rotating inclined and wobbling motion of the orbiting scroll member.

More specifically, the invention provides an oil control mechanism that meters lubrication to the orbiting and fixed scroll wraps to control refrigerant leakage. Oil is metered effectively by pressure differentials created within the compressor. An oil pool of sufficient depth is located beneath the orbiting scroll and extends above the top surface of the orbiting scroll plate. The required amount of lubricant is needed for scroll run in and normal operation is automatically pulled into the intermeshed scrolls.

An advantage of the scroll-type compressor of the present invention is the provision of an axial compliance mechanism that resists axial separation of the scroll members caused by both separating force and overturning moments applied to the orbiting scroll member.

Another advantage of the scroll-type compressor of the present invention is that wobbling motion of the orbiting scroll member is effectively minimized without increasing the constantly applied axial compliance force, thereby improving sealing properties while mini7 mizing power consumption.

A further advantage of the scroll-type compressor of the present invention is that a controlled quantity of oil is used to control leakage while the compressor is running.

Yet another advantage of the scroll-type compressor of the present invention is the provision of a mechanism for counteracting the rotating inclined wobbling motion of the orbiting scroll member that functions independently of static pressure levels utilized for counteracting the separating forces between the scroll members.

Another advantage of the scroll-type compressor of the present invention is that scroll run-in time is reduced by the oil flow through the scroll wraps.

A still further advantage of the scroll compressor of the present invention is the provision of a simple, reli7 able, inexpensive, and easily manufactured compliance mechanism for producing a constantly applied force on the orbiting scroll plate toward the fixed scroll member, and for producing a reactionary force in response to wobbling/tilting motion of the orbiting scroll member.

The scroll compressor of the present invention, in one form thereof, provides a hermetic scroll-type compressor including a housing having a discharge pressure chamber at discharge pressure and a suction pressure chamber at suction pressure. Within the housing are fixed and orbiting scroll members having respective wraps that are operably intermeshed to define compression pockets therebetween. A crankshaft is drivingly coupled to the orbiting scroll member at a location spaced axially from the intermeshed wraps, thereby causing the orbiting scroll member to orbit relative to the fixed scroll member. A radially inner portion of a back surface of the orbiting scroll member is exposed to the discharge pressure chamber, and a radially outer portion of the back surface is exposed to the suction pressure chamber, thereby exerting an axial compliance force on the orbiting scroll member toward the fixed scroll member. The drive force exerted on the orbiting scroll member is at a location spaced axially from the intermeshed wraps, thereby causing the orbiting scroll member to experience an overturning moment that results in a rotating inclined motion of the orbiting scroll member. A mechanism is provided whereby a reactionary force is applied to the radially outer portion of the back surface in response to wobbling/tilting motion of the orbiting scroll member, thereby counteracting the wobbling/tilting motion and improving sealing between the fixed and orbiting scroll members. The mechanism involves an oil pool that is defined by an annular oil chamber having a bottom surface above which the radially outer portion of the back surface of the orbiting scroll member orbits in spaced relationship therewith. The back surface of the orbiting member is sufficiently large and the chamber is provided with oil of a sufficient depth to effectively fill the space between the bottom surface of the oil chamber and the back surface of the orbiting scroll member to cause application of a force to the back surface by the oil when the angular inclination of the orbiting scroll member wobbles and reduces the space between the bottom surface and the back surface.

DESCRIPTION OF THE PREFERRED EMBODIMENT

Figure 1:
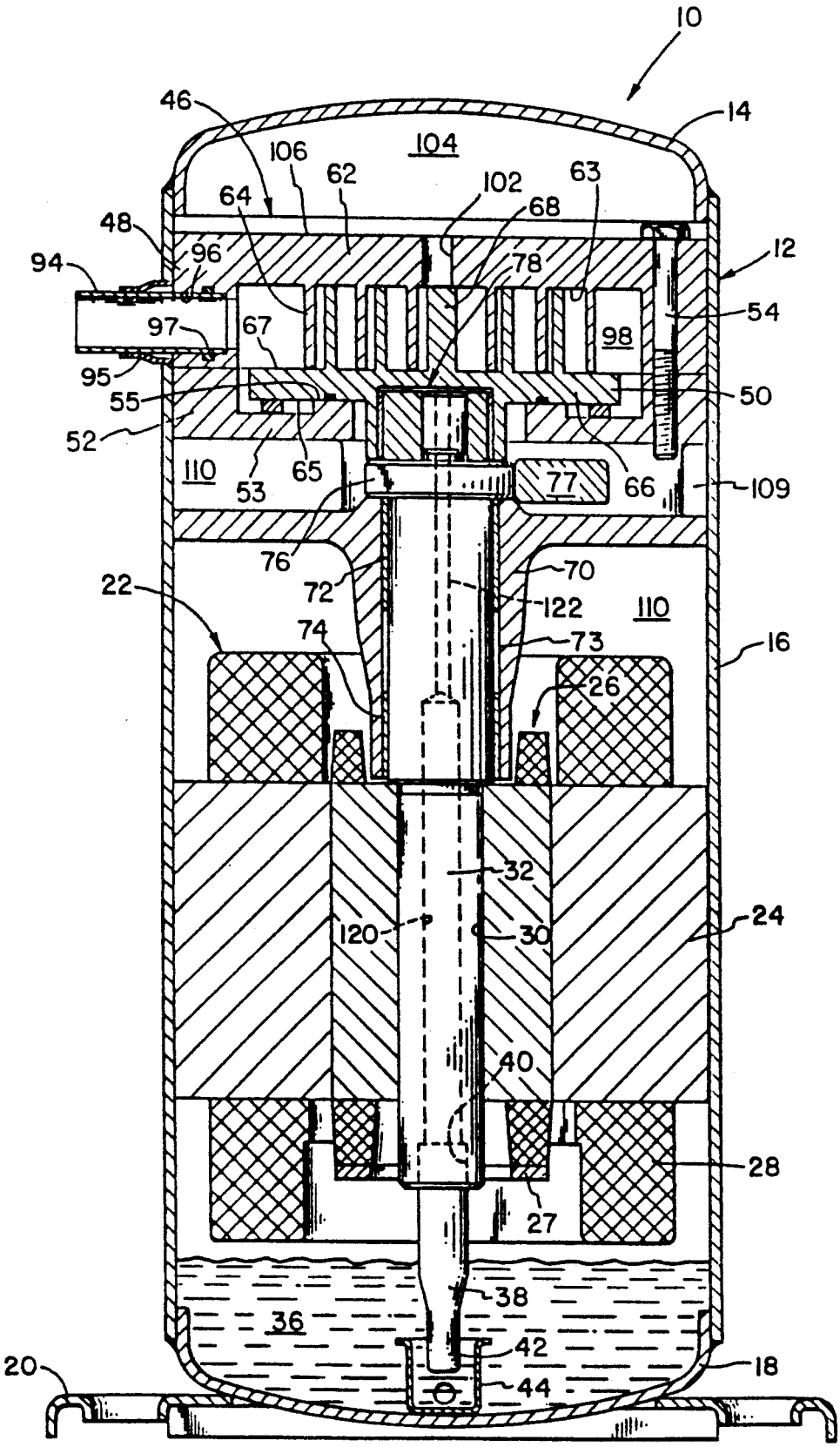
FIG. 1 is a longitudinal sectional view of a compressor of the type to which the present invention pertains, taken along the line 1—1 in FIG. 4 and viewed in the direction of the arrows.
Figure 2:
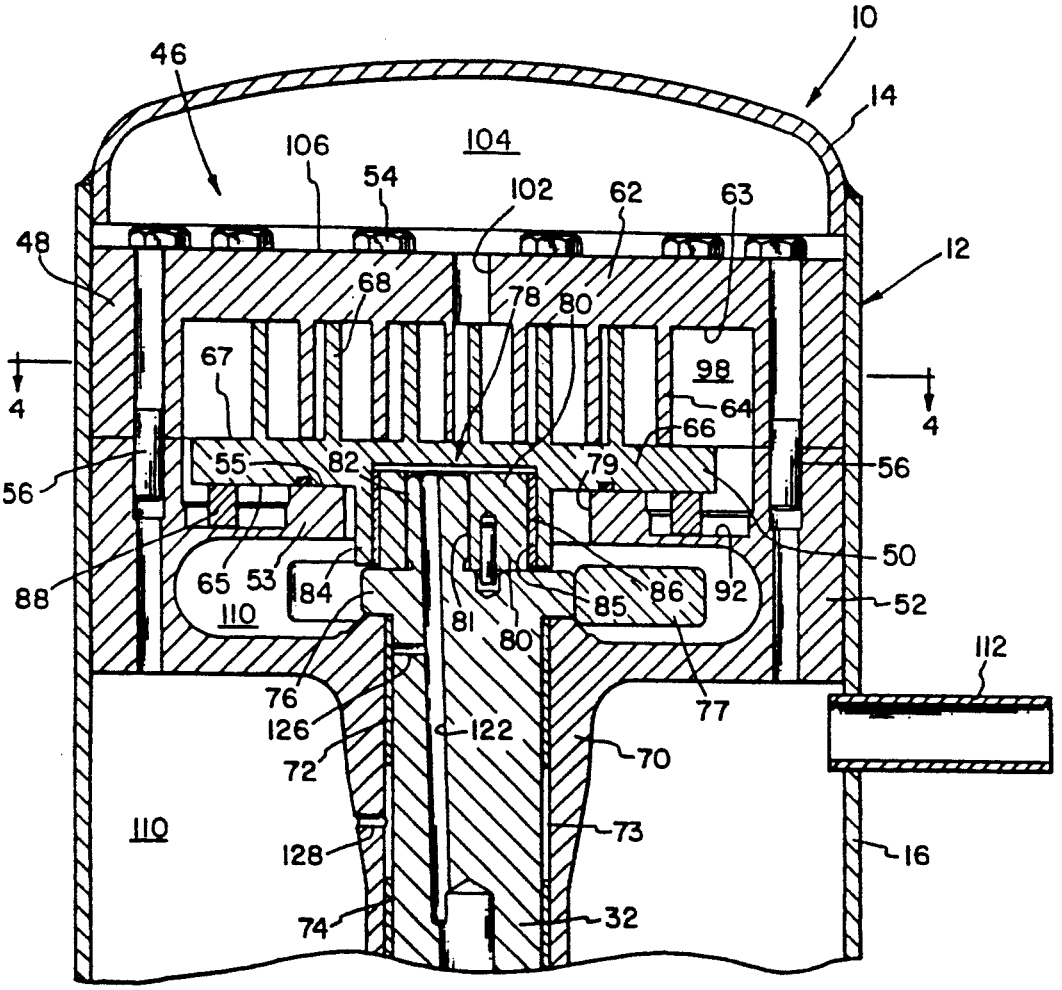
FIG. 2 is an enlarged fragmentary sectional view of the compressor of FIG. 1, taken along the line 2—2 in FIG. 4 and viewed in the direction of the arrows.

In an exemplary embodiment of the invention as shown in the drawings, and in particular by referring to FIGS. 1 and 2, a compressor 10 is shown having a housing generally designated at 12. This embodiment is only provided as an example and the invention is not limited thereto. The housing has a top cover portion 14, a central portion 16, and a bottom portion 18, wherein central portion 16 and bottom portion 18 may alternatively comprise a unitary shell member. The three housing portions are hermetically secured together as by welding or brazing. A mounting flange 20 is welded to bottom portion 18 for mounting the compressor in a verti7 cally upright position. Located within hermetically sealed housing 12 is an electric motor generally designated at 22, having a stator 24 and a rotor 26. Stator 24 is secured within central portion 16 of the housing by an interference fit such as by shrink fitting, and is provided with windings 28. Rotor 26 has a central aperture 30 provided therein into which is secured a crankshaft 32 by an interference fit. The rotor also includes a counterweight 27 at the lower end ring thereof. A terminal cluster 34 (FIG. 4) is provided in central portion 16 of housing 12 for connecting motor 22 to a source of electric power.

Compressor 10 also includes an oil sump 36 generally located in bottom portion 18. A centrifugal oil pickup tube 38 is press fit into a counterbore 40 in the lower end of crankshaft 32. Oil pickup tube 38 is of conventional construction and includes a vertical paddle (not shown) enclosed therein. An oil inlet end 42 of pickup tube 38 extends downwardly into the open end of a cylindrical oil cup 44, which provides a quiet zone from which high quality, non-agitated oil is drawn.

Compressor 10 includes a scroll compressor mechanism 46 enclosed within housing 12. Compressor mechanism 46 generally comprises a fixed scroll member 48, an orbiting scroll member 50, and a main bearing frame member 52. As shown in FIG. 1, fixed scroll member 48 and frame member 52 are secured together by means of a plurality of mounting bolts 54. Precise alignment between fixed scroll member 48 and frame member 52 is accomplished by a pair of locating pins 56. Frame member 52 is mounted within central portion 16 of housing 12 by means of a plurality of circumferentially disposed mounting pins (not shown) of the type shown and described in assignee's U.S. Pat. No. 4,846,635, the disclosure of which is hereby incorporated herein by reference. The mounting pins facilitate mounting of frame member 52 such that there is an annular gap between stator 24 and rotor 26.

Fixed scroll member 48 comprises a generally flat face plate 62 having a face surface 63, and an involute fixed wrap 64 extending axially from surface 63. Likewise, orbiting scroll member 50 comprises a generally flat face plate 66 having a back surface 65, a top face surface 67, and an involute orbiting wrap 68 extending axially from surface 67. Fixed scroll member 48 and orbiting scroll member 50 are assembled together so that fixed wrap 64 and orbiting wrap 68 operatively interfit with each other. Furthermore, face surfaces 63, 67 and wraps 64, 68 are manufactured or machined such that, during compressor operation when the fixed and orbiting scroll members are forced axially toward one another, the tips of wraps 64, 68 sealingly engage with respective opposite face surfaces 67, 63.

Main bearing frame member includes an annular, radially inwardly projecting portion 53, including an axially facing stationary thrust surface 55 adjacent back surface 65 and in opposing relationship thereto. Back surface 65 and thrust surface 55 lie in substantially parallel planes and are axially spaced according to machining tolerances and the amount of permitted axial compli7 ance movement of orbiting scroll member 50 toward fixed scroll member 48.

Main bearing frame member 52, as shown in FIGS. 1 and 2, further comprises a downwardly extending bearing portion 70. Retained within bearing portion 70, as by press fitting, is a conventional sleeve bearing assembly comprising an upper bearing 72 and a lower bearing 74. Two sleeve bearings are preferred rather than a single longer sleeve bearing to facilitate easy assembly into bearing portion 70 and to provide an annular space 73 between the two bearings 72, 74. Accordingly, crankshaft 32 is rotatably journalled within bearings 72, 74.

Figure 4:
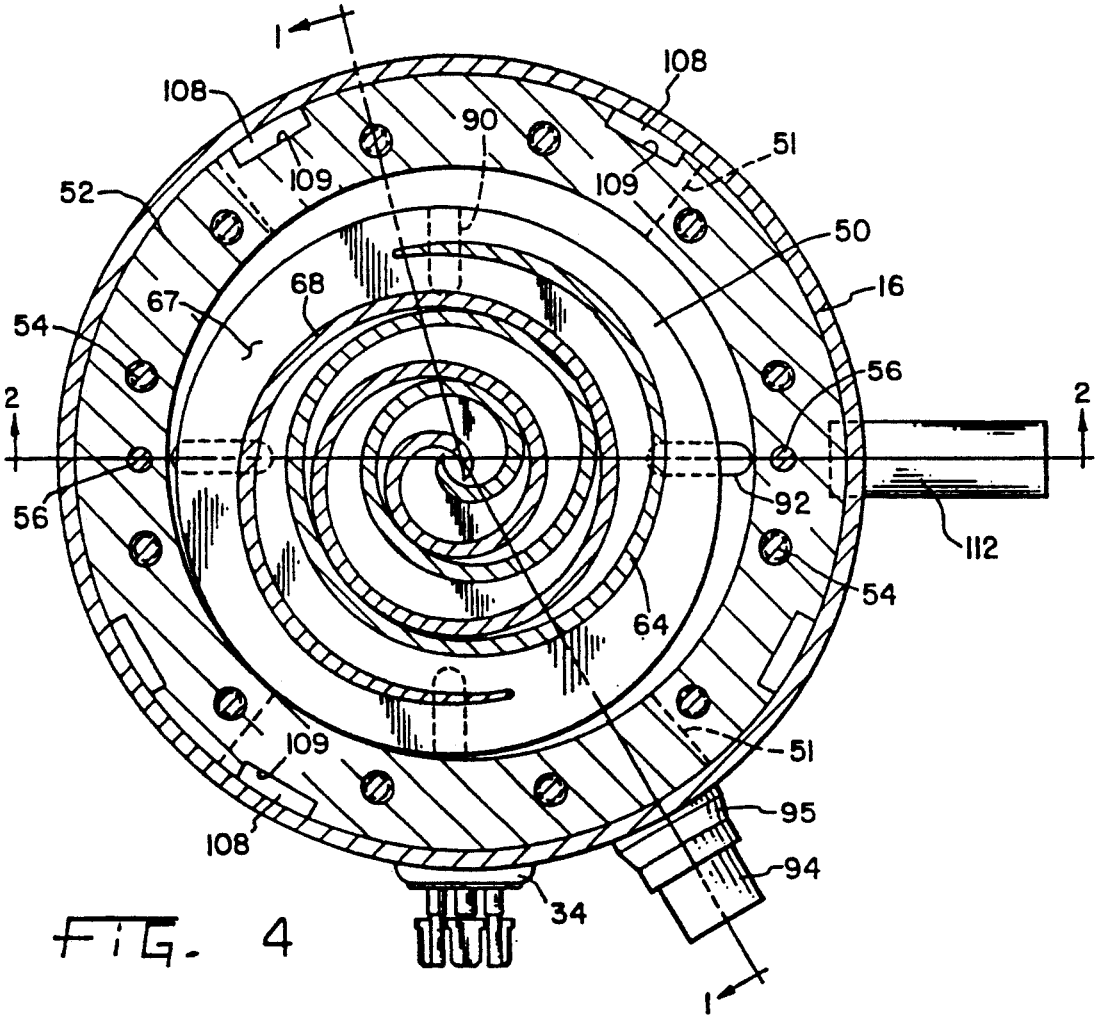
FIG. 4 is an enlarged transverse sectional view of the compressor of FIG. 1, taken along the line 4—4 in FIG. 2 and viewed in the direction of the arrows.
Figure 5:
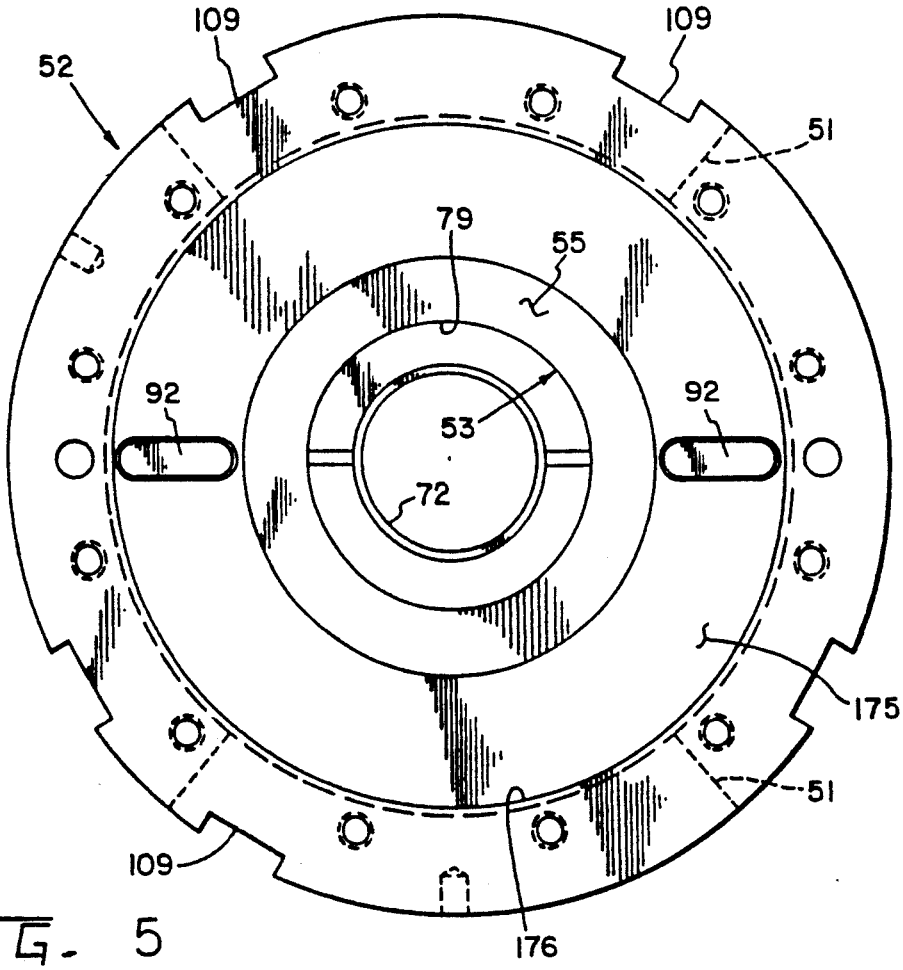
FIG. 5 is an enlarged top view of the main bearing frame member of the compressor of FIG. 1.

Crankshaft 32 includes a concentric thrust plate 76 extending radially outwardly from the sidewall of crankshaft 32. A balance weight 77 is attached to thrust plate 76, as by bolts 75. In the preferred embodiment disclosed herein, the diameter of thrust plate 76 is less than the diameter of a round opening 79 defined by inwardly projecting portion 53 of frame 52, whereby crankshaft 32 may be inserted downwardly through opening 79. Once crankshaft 32 is in place, balance weight 77 is attached thereto through one of a pair of radially extending mounting holes 51 extending through frame member 52, as shown in FIGS. 4 and 5. This mounting holes also ensures that the space surrounding thrust plate 76 is part of housing chamber 110 at discharge pressure via passages 108 defined by axially extending notches 109 formed in the outer periphery of frame 52.

Figure 3:
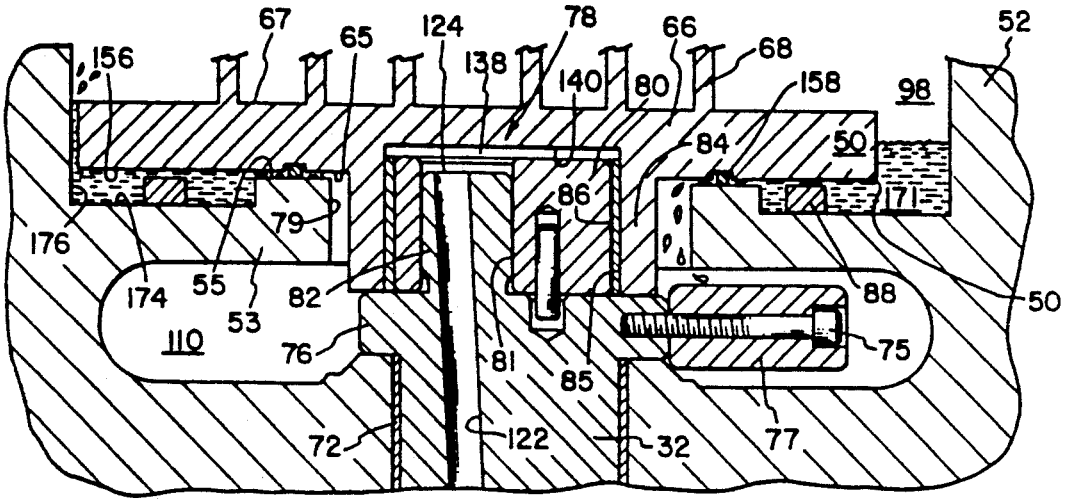
FIG. 3 is an enlarged fragmentary sectional view of the compressor of FIG. 1, particularly showing the orbiting scroll member compliance mechanism of the present invention.

An eccentric crank mechanism 78 is situated on the top of crankshaft 32, as best shown in FIGS. 2 and 3. According to a preferred embodiment, crank mechanism 78 comprises a cylindrical roller 80 having an axial bore 81 extending therethrough at an off-center location. An eccentric crankpin 82, constituting the upper, offset portion of crankshaft 32, is received within bore 81, whereby roller 80 is eccentrically journalled about eccentric crankpin 82. Orbiting scroll member 50 includes a lower hub portion 84 that defines a cylindrical well 85 into which roller 80 is received. Roller 80 is journalled for rotation within well 85 by means of a sleeve bearing 86, which is press fit into well 85. Each of sleeve bearings 72, 74, and 86 is preferably a steel-backed bronze bushing.

When crankshaft 32 is rotated by motor 22, the operation of eccentric crankpin 82 and roller 80 within well 85 causes orbiting scroll member 50 to orbit with respect to fixed scroll member 48. Roller 80 pivots slightly about crankpin 82 so that crank mechanism 78 functions as a conventional swing-link radial compli7 ance mechanism to promote sealing engagement between fixed wrap 64 and orbiting wrap 68. This mechanism also controls the amount of lubrication between scroll members 48 and 50. Orbiting scroll member 50 is prevented from rotating about its own axis by means of a conventional Oldham ring assembly, comprising an Oldham ring 88, and Oldham key pairs 90, 92 associated with orbiting scroll member 50 and frame member 52, respectively.

In operation of compressor 10 of the preferred embodiment, refrigerant fluid at suction pressure is introduced through a suction tube 94, which is sealingly received within a counterbore 96 in fixed scroll member 48 with the aid of an O-ring seal 97. Suction tube 94 is secured to the compressor by means of a suction tube adaptor 95 that is silver soldered or brazed at respective ends to the suction tube an opening in the housing. A suction pressure chamber 98 is generally defined by fixed scroll member 48 and frame member 52. Refrigerant is introduced into chamber 98 from suction tube 94 at a radially outer location thereof. As orbiting scroll member 50 is caused to orbit, refrigerant fluid within suction pressure chamber 98 is compressed radially inwardly by moving closed pockets defined by fixed wrap 64 and orbiting wrap 68.

Refrigerant fluid at discharge pressure in the innermost pocket between the wraps is discharged upwardly through a discharge port 102 communicating through face plate 62 of fixed scroll member 48. Compressed refrigerant discharged through port 102 enters a discharge plenum chamber 104 defined by top cover portion 14 and top surface 106 of fixed scroll member 48. Previously described axially extending passages 108 allow the compressed refrigerant in discharge plenum chamber 104 to be introduced into housing chamber 110 defined within housing 12. As shown in FIG. 2, a discharge tube 112 extends through central portion 16 of housing 12 and is sealed thereat as by silver solder. Discharge tube 112 allows pressurized refrigerant within housing chamber 110 to be delivered to the refrigeration system (not shown) in which compressor 10 is incorporated.

Compressor 10 also includes a lubrication system for lubricating the moving parts of the compressor, including the scroll members, crankshaft, and crank mechanism. An axial oil passageway 120 is provided in crankshaft 32, which communicates with tube 38 and extends upwardly along the central axis of crankshaft 32. At a central location along the length of crankshaft 32, an offset, radially divergent oil passageway 122 intersects passageway 120 and extends to an opening 124 o the top of eccentric crankpin 82 at the top of crankshaft 32. As crankshaft 32 rotates, oil pickup tube 38 draws lubricating oil from oil sump 36 and causes oil to move upwardly through oil passageways 120 and 122. Lubrication of upper bearing 72 and lower bearing 74 is accomplished by means of flats (not shown) formed in crankshaft 32, located in the general vicinity of bearings 72 and 74, and communicating with oil passageways 120 and 122 by means of radial passages 126. A vent passage 128 extends through bearing portion 70 to provide communication between annular space 73 and discharge pressure chamber 110.

Referring now to FIG. 3, lubricating oil pumped upwardly through offset oil passageway 122 exits crankshaft 32 through opening 124 located on the top of eccentric crankpin 82. Lubricating oil delivered from hole 124 fills a chamber 138 within well 85, defined by bottom surface 140 of well 85 and the top surface of crank mechanism 78, including roller 80 and crankpin 82. Oil within chamber 138 tends to flow downwardly along the interface between roller 80 and sleeve bearing 86, and the interface between bore 81 and crankpin 82, for lubrication thereof. A flat (not shown) may be provided in the outer cylindrical surfaces of roller 80 and crankpin 82 to enhance lubrication.

Referring now to FIG. 3, lubricating oil is provided by the aforementioned lubrication system to the central portion of the underside of orbiting scroll member 50 within well 85. Accordingly, when the lubricating oil fills chamber 138, an upward force acts upon orbiting scroll member 50 toward fixed scroll member 48. The magnitude of this upward force, determined by the surface area of bottom surface 140, is insufficient to provide the necessary axial compliance force. Therefore, in order to increase the upward force on orbiting scroll member 50, an annular portion of back surface 65 immediately adjacent, i.e., circumjacent, hub portion 84 is exposed to refrigerant fluid at discharge pressure.

The oil control mechanism of the present invention automatically provides the proper amount of lubricant to orbiting scroll member 50 and fixed scroll member 48. The control mechanism operates such that as the scroll set (the orbiting scroll member 50 with fixed scroll member 48) wears and oil requirements are reduced, internal oil flow rates are likewise reduced.

Initially, the scroll members 48 and 50 have a large amount of leakage between themselves that requires a large volume of oil to fill. The oil control mechanism comprises the use of the pressure differentials created at seal member 158 beneath orbiting scroll 50, in the oil pool 171, and on a top face surface 67 of the orbiting scroll plate 66. Top face surface 67 radially outside of scroll wrap 68 is also known as the orbiting plate flange or upper peripheral edge of orbiting scroll 50. These elements separately and together control the oil flow rate during various compressor conditions.

The first control portion is the space between the counterweight 77 and orbiting scroll seal 158. The second control area comprises the oil pool 171 and the third control portion includes the space above orbiting scroll plate flange 67.

As described above, as compressor 10 operates, oil is pumped up through crankshaft 32 and flows down past bearing 86 onto counterweight 77. At this point, the movement of orbiting scroll 50, and more particularly, the pressure differential between counterweight chamber 110 and the area opposite seal 158 creates a vacuuming effect that lifts oil off of counterweight 77 and forces the oil into oil pool 171. The affect of the pressure differential on the oil laying on counterweight 77 can be analogized to a vacuum cleaner nozzle held directly over a pan of water. The vacuum will tend to pull droplets of water out of the pan and into the vacuum cleaner, thereby removing water from the pan. It is the vacuuming action caused by the pressure differential present during compressor operation that lifts the oil off of counterweight 77 past seal member 158 and into oil pool 171. Alternatively, mechanical means such as a pump may be used to communicate oil to seal member 158.

Oil pool 171 becomes filled with oil because of the previously described vacuuming effect. As the scroll set starts operating with a particular amount of leakage, the scroll members 48 and 50 create a pressure differential that literally pulls oil from oil pool 171 into scroll wraps 64 and 68. The level of oil pool 171 is such that the oil fills an area underneath orbiting scroll 50, and rises to the level of top face surface 67 as shown in FIG. 3. The oil laying on orbiting scroll plate flange 67 is then swept into scroll wraps 64 and 68 during the orbiting movement of orbiting scroll 50. The movement of orbiting scroll member 50 permits fixed scroll wrap 64 to wipe oil laying on top face surface 67 into the scroll compression spaces. This wiping action can be analogized to that of a windshield wiper on a automobile. The relative movement of fixed scroll wrap 64 over orbiting scroll base plate 66 meters a quantity of oil that is sucked into the compression spaces as necessitated by the current scroll leakage condition.

The relative movement of scroll wraps 64 and 68 causes the wraps to try and compress the incompressible oil, forcing the oil to move into the leak spaces of the scroll wraps. Once all the leak spaces are filled up, the compressor tries to compress the oil, which it cannot do. As the pressure leaks between the scrolls become smaller, there is less and less demand for oil. The radial compliance force of orbiting scroll 50 controls how much oil continues to be pulled through the compressor, since there are now effectively no refrigerant leaks between the scroll wraps.

In other words, as scroll wraps 64 and 68 wear in, the leaks spaces between the wraps become smaller. Therefore, the amount of oil going out between wraps 64 and 68 to the discharge port 102, becomes smaller. As the oil loss rate slows within the wraps, the rate of oil drawn out of oil pool 171 also becomes smaller. This occurs because the pressure drop now between the top surface 67 (the top peripheral surface of orbiting scroll 50) and the scroll wraps 64 and 68 is now lower.

As the oil loss rate from oil pool 171 becomes smaller, the pressure differential between oil pool 171 and counterweight chamber 100 is reduced, thereby reducing the oil drawn through orbiting plate seal 158. The reduction of oil drawn past the orbiting plate seal 158 from the top of counterweight 77 is caused by the elimination of the pressure drop past the seal. The fact that causes the previously described behavior is that the pool of oil is not at suction pressure near the outside diameter of annular seal 158.

Eventually, an equilibrium oil flow rate is established after the oil pool is filled such that the oil flow rate from the crankshaft 32 is equal to the rate of oil flow out of the scroll wraps 64, 68 through discharge port 102. The rate of oil flow through the scroll set is controlled by the magnitude of the radial compliance force and the leakage paths between the scroll sets. The aforementioned structure operates as an oil control mechanism to meter the oil flow rate through compressor 10. The wear in or run in of scroll wraps 64 and 68 depends on the proper amount of lubrication.

The length of time needed to adequately wear in a set of scroll wraps may be substantially decreased with the right amount of lubrication. A method of wearing or running in the orbiting and fixed scroll wraps is disclosed as forming an oil pool 171 within the oil chamber, and operating the compressor to run together the orbiting and fixed scroll wraps 64 and 68 so that the internal oil rate is reduced to an equilibrium rate. By forming oil pool 171 so that it extends above the upper peripheral edge of the orbiting scroll flange, the interengaged scrolls automatically control how much oil they consume.

The method of running in the scroll wraps may further include the step of radially biasing scroll wraps 64 and 68 together to further control the oil metering aspects of the scroll set. By increasing the radial compliance force between scroll wraps 64 and 68, the oil flow rate between scroll wraps 64 and 68 is decreased.

After scroll wraps 64 and 68 have been properly run in or worn in, a reduction of differential pressures within the compressor slow the internal flow rate of the oil, preventing too much oil from entering the scroll set. Reduction of differential pressure between the scroll wraps 64, 68 and oil pool 171 and pressure reduction past seal 158 slows internal oil flow.

Differential pressure is reduced in one way by the scrolls themselves requiring less oil as the wraps are worn to conform to each other.

Further, the internal oil flow rate may be decreased by a reduction of the differential pressure across seal 158 such that oil flow past seal 158 settles to an equilibrium rate. The differential pressure across seal 158 is automatically reduced when the scroll wraps 64 and 68 themselves require less oil.

Compressor 10 includes an axial compliance mechanism characterized by two component forces, the first force being a constantly applied force dependent upon the magnitude of the pressures in discharge pressure chamber 110 and suction pressure chamber 98, and the second force being primarily a reactionary force applied to the orbiting scroll member in response to rotating inclined and wobbling motion caused by overturning moments experienced by the orbiting scroll member due to forces imparted thereto by the drive mechanism.

With regard to the first constantly applied force of the axial compliance mechanism, respective fixed portions of back surface 65 are exposed to discharge and suction pressure, thereby providing a substantially constant force distribution acting upwardly upon orbiting scroll member 50 toward fixed scroll member 48. Consequently, moments about the central axis of orbiting scroll member 50 are minimized. More specifically, an annular seal mechanism 158, cooperating between back surface 65 and adjacent stationary thrust surface 55, sealingly separates between a radially inner portion 154 and a radially outer portion 156 of back surface 65, which are exposed to discharge pressure and suction pressure, respectively. As will be further explained here, seal mechanism 158 includes an annular seal groove 152 formed in back surface 65.

Figure 7:
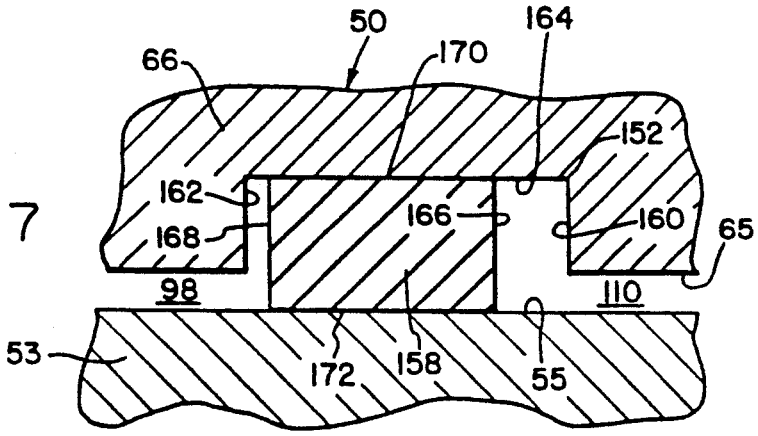
FIG. 7 is an enlarged fragmentary sectional view of the annular seal element of the compressor of FIG. 1, shown in a non-actuated state.
Figure 8:
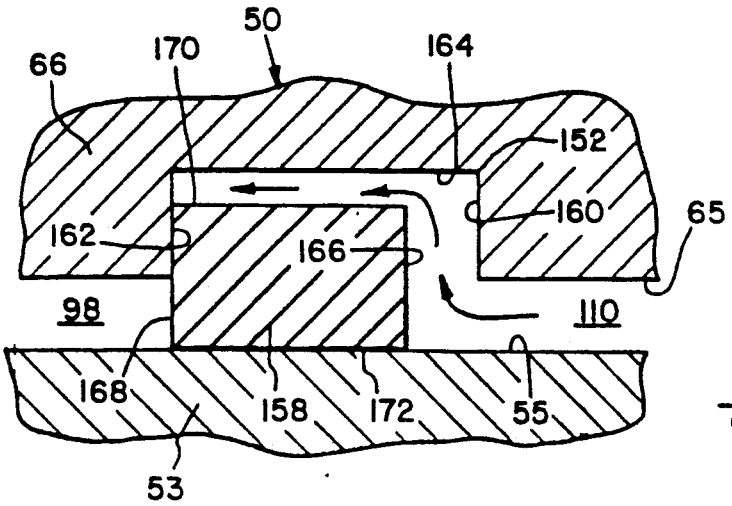
FIG. 8 is an enlarged fragmentary sectional view of the annular seal element of the compressor of FIG. 1, shown in an actuated state.

Referring to FIGS. 7 and 8, the seal mechanism comprises an annular elastomeric seal element 158 unattachedly received within seal groove 152. In the preferred embodiment, the radial thickness of seal element 158 is less than the radial width of seal groove 152, as best shown in FIGS. 7 and 8. Referring to FIG. 7, wherein seal element 158 is shown in an unactuated state when the compressor is off, the axial thickness of seal element 158 is greater than the axial depth of seal groove 152 so a to slightly space back surface 65 from thrust surface 55.

Referring again to FIG. 7, annular seal groove 152 includes a radially inner wall 160, a radially outer wall 162, and a bottom wall 164 extending therebetween. Likewise, annular seal element 158 is generally rectangular and includes a radially inner surface 166, a radially outer surface 168, a top surface 170 and a bottom surface 172. In it's unactuated condition shown in FIG. 7, seal element 158 has a diameter less than the diameter of outer wall 162, whereby outer surface 168 is slightly spaced from outer wall 162.

In a 40,000 BTU embodiment of the invention, for example, the outer diameter of thrust surface 55 is 3.48 in., the outer diameter of the flange portion of orbiting scroll 50 is 4.88 in., the average depth of oil pool 171 is 0.22 in., the oil viscosity is 100–300 SUS, and the overturning moment arm (½ the wrap height to the midpoint of bearing 86) is 1.172 in. The clearance of the outer edge of orbiting scroll member 50 to sidewall 176 of the oil chamber (FIG. 9) is preferably in the range of 0.001 in. to 0.100 in., for example 0.025 in., in an exemplary embodiment. Depending on the design compression ratio, operating pressure conditions and scroll and seal geometry, these dimensions may change In operation of compressor 10, axial compliance of orbiting scroll member 50 toward fixed scroll member 48 occurs as the compressor compresses refrigerant fluid for discharge into housing chamber 110. As housing chamber 110 becomes pressurized, discharge pressure occupies the volume shown radially inwardly from inner wall 166 in FIG. 7, thereby causing seal element 158 to expand radially outwardly and scroll member 50 to move axially upwardly away from thrust surface 55, as shown in FIG. 8. As a result of the axial movement of scroll member 50, increased space is created between back surface 65 and thrust surface 55. Seal element 158 moves downwardly toward thrust surface 55 under the influence of gravity and/or a venturi effect created by the initial fluid flow between bottom surface 172 and thrust surface 55. Consequently, discharge pressure occupies the space between bottom wall 164 and top surface 170. From the foregoing, it will be appreciated that discharge pressure acting on top surface 170 and inner surface 166 of seal element 158 creates a force distribution on the seal element that urges it axially downwardly toward thrust surface 55 and radially outwardly toward outer wall 168 to seal thereagainst.

The annular seal element disclosed herein is preferably composed of a Teflon material. More specifically, a glass-filled Teflon, or a mixture of Teflon, Carbon, and Ryton is preferred in order to provide the seal element with the necessary rigidity to resist extruding into clearances due to pressure differentials. The materials indicated above are only examples and any other conventional materials could be used. Furthermore, the surfaces against which the Teflon seal contacts could be cast iron or other conventional materials.

Figure 9:
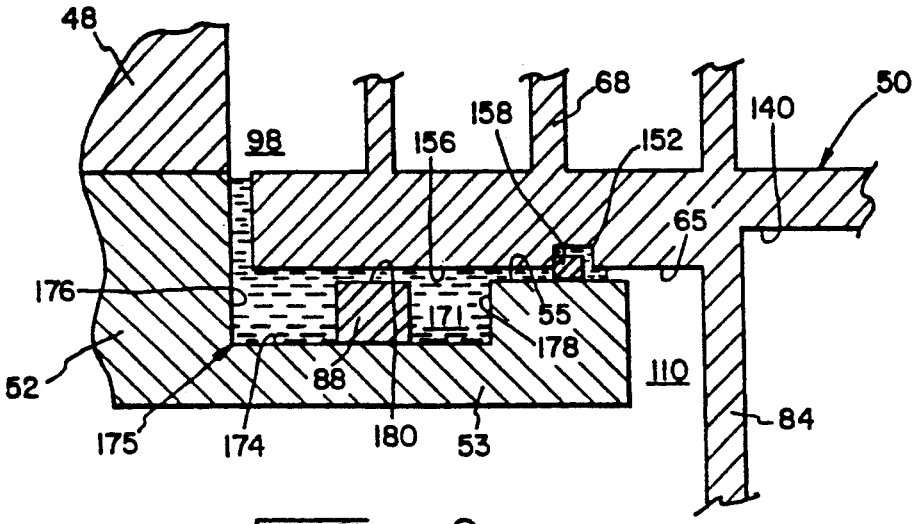
FIG. 9 is a enlarged fragmentary sectional view of the compliance mechanism of FIG. 3, particularly showing the outer flange of the orbiting scroll member and the oil pool therebeneath.

As previously described, the axial compliance mechanism in accordance with the present invention is characterized by a second reactionary force applied to the orbiting scroll member in response to rotating inclined and wobbling motion thereof. This is accomplished by providing an oil pool 171 adjacent the radially outer portion 156 of back surface 65 of orbiting scroll member 50, as shown in FIGS. 3 and 9. More specifically with reference to FIG. 9, fixed scroll member 52 defines an annular oil chamber 175 having a bottom surface 174, an outer sidewall 176, and an inner sidewall 178 rising from bottom surface 174 to meet thrust surface 55.

Figure 10:
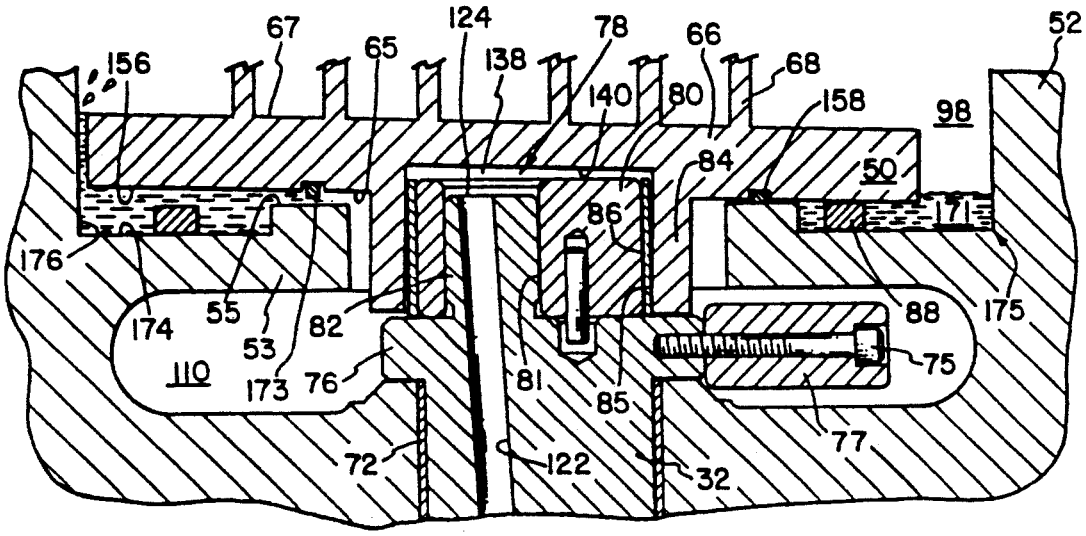
FIG. 10 is a sectional view similar to FIG. 3 showing the inclined orbiting scroll in greatly exaggerated fashion.
Figure 6:
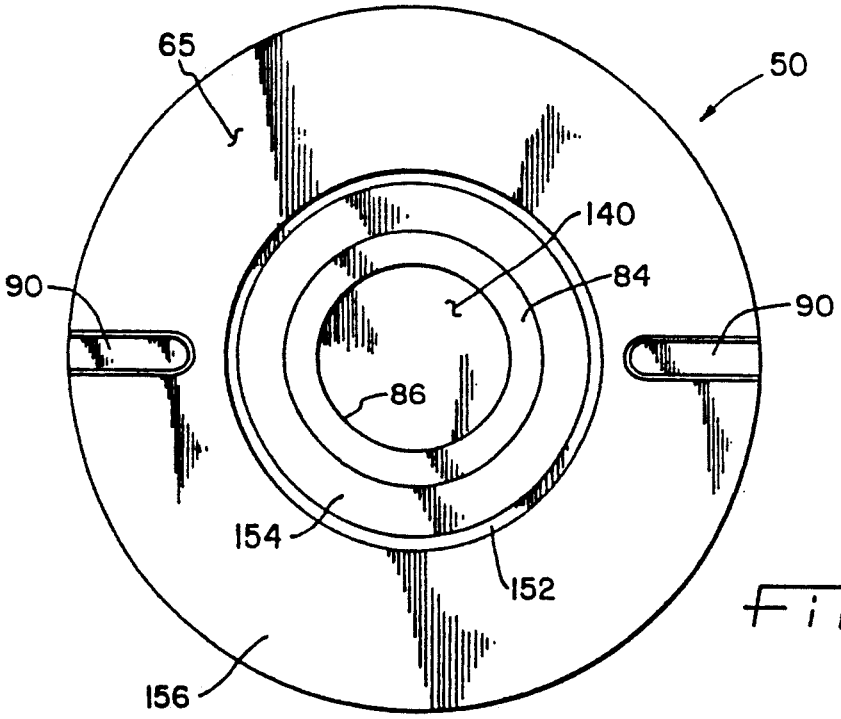
FIG. 6 is an enlarged bottom view of the orbiting scroll member of the compressor of FIG. 1.

In reference to FIG. 10, the inclined orientation of orbiting scroll member 50 is shown. The tilting motion is caused by an overturning moment resulting from forces acting on the orbiting scroll 50 and fixed scroll 52. The wedge-shaped pool of oil 171 is shown on the left side of FIG. 10. It should be noted that seal 58 is lifted slightly off thrust surface 55, thereby producing a widened gap 173 that permits oil to be pumped radially outwardly into wedge-shaped oil pool 171, thereby providing an increased force against the wobbling/tilting perturbations of orbiting scroll 50. It should be noted that the illustration of the inclination of orbiting scroll 50 in FIG. 10 is greatly exaggerated in order to illustrate the principles involved. As mentioned earlier, the rotating inclined motion of the orbiting scroll member will cause a rotating leak to occur between seal 158 and thrust surface 55, thereby pumping additional oil into the wedge-shaped oil pool 171 (FIG. 10).

Radially outer portion 156 of back surface 65 orbits above bottom surface 174 of oil chamber 175 in spaced relationship therewith. Oil pool 171 is shown having sufficient depth in oil chamber 175 to fill the space between bottom surface 174 and radially outer portion 156 of back surface 65. In this manner, rotating inclined wobbling motion of the orbiting scroll member results in an attempt to decrease the aforementioned space and thereby compress oil pool 171, which attempt is met by a reaction force exerted by the wedge-shaped oil pool on the back surface of the orbiting scroll member.

Oil is initially delivered to oil chamber 175 in order to establish oil pool 171, by development of a differential pressure across an initially underlubricated seal element 158. Referring once again to FIG. 3 and the previous discussion relating to the lubrication system of the present invention, oil that flows downwardly along the interface between roller 80 and sleeve bearing 86, and along the interface between bore 81 and crankpin, moves radially outwardly along the top surface of thrust plate 76 and is broadcast by interaction with rotating counterweight 77. This broadcasting action, along with the vacuuming effect described earlier, causes the oil to move upwardly along the annular space intermediate opening 79 and hub portion 84 and then radially outwardly to seal element 158. Initially, a relatively high rate of leakage past the seal element causes establishment of oil pool 171, which is maintained thereafter by minimal flow of oil past the seal element.

It will be appreciated that oil pool 171 is located within suction pressure chamber 98; however, the reaction force exerted by the oil pool on the orbiting scroll member in response to rotating inclined wobbling motion thereof is independent of ambient pressure level. Furthermore, application of the reactionary impulse force at a radially outermost portion of the orbiting scroll member results in the largest moment and, hence, the maximum benefit for resisting rotating inclined wobbling motion. Accordingly, the diameter of the back surface 156 must be sufficiently large to react with the oil pool 171 to dampen the inclined wobbling motion of orbiting scroll 50. At the same time, the first constantly applied axial compliance force need not be made excessively large in order to compensate for rotating inclined wobbling motion. Rather, the net force applied by the combination of discharge pressure and suction pressure on the back surface of the orbiting scroll member need only be great enough to resist the separating forces and moments produced in the compression pockets.

In the disclosed embodiment, Oldham ring 88 is disposed within oil chamber 175 thereby interacting with oil pool 171 during orbiting motion of the orbiting scroll member 50. It is believed that the placement of Oldham ring 88 within oil pool 171 and the agitation of the oil results in hydraulic forces being applied to back surface 65 of orbiting scroll member 50 that would not exist in its absence. Specifically, the Oldham ring experiences reciprocating motion relative back surface 65 and bottom surface 174, thereby causing localized hydraulic pressurization of the oil at the boundaries of the Oldham ring as the Oldham ring acts as a squeegee against the inertial forces of the oil. It is believed that this dynamic action causes an additional localized axial force on the orbiting scroll member to further enhance axial sealing.

It will be appreciated that the foregoing description of one embodiment of the invention is presented by way of illustration only and not by way of any limitation, and that various alternatives and modifications may be made to the illustrated embodiment without departing from the spirit and scope of the invention.

What is claimed is:

1. A hermetic scroll compressor comprising:

a hermetically sealed housing including therein a discharge chamber at discharge pressure and a suction chamber at suction pressure;

a fixed scroll member in said housing including an involute fixed wrap element;

an orbiting scroll member in said housing including a plate portion having a face surface and a back surface, said face surface having an involute orbiting wrap element thereon intermeshed with said fixed wrap element, said orbiting scroll member plate portion having a flange extending radially beyond said orbiting wrap element, said flange including an upper peripheral edge;

a frame including a thrust surface adjacent said orbiting scroll member back surface;

a seal between said orbiting scroll member and said thrust surface sealingly separating between respective portions of said plate portion back surface exposed to discharge pressure and suction pressure;

drive means for causing said orbiting scroll member to orbit relative to said fixed scroll member;

means defining an oil chamber in which said orbiting scroll member flange orbits, said oil chamber at suction pressure; and an oil pool of sufficient depth in said oil chamber to extend said oil pool above said upper peripheral edge of said orbiting scroll member as said orbiting scroll orbits, whereby oil from the oil pool is sucked between the intermeshed scrolls.

2. The compressor of claim 1 in which said compressor further comprises a radial compliance means for biasing said orbiting scroll member radially toward said fixed scroll member to control oil flow through said compressor.

3. The compressor of claim 1 in which said oil pool contacts said seal.

4. The compressor of claim 1 in which said oil from said oil pool fills spaces between said intermeshed scroll wraps.

5. A hermetic scroll compressor comprising:

a hermetically sealed housing including therein a discharge chamber at discharge pressure and a suction chamber at suction pressure;

said housing including an oil chamber containing oil;

a fixed scroll member in said housing including an involute fixed wrap element;

an orbiting scroll member disposed in said oil chamber, said orbiting scroll member including a plate portion having a face surface and a back surface, said face surface having an involute orbiting wrap element thereon intermeshed with said fixed wrap element, said orbiting scroll member plate portion having a flange extending radially beyond said orbiting wrap element, said flange including an upper peripheral edge, said oil in said oil chamber of sufficient depth of extend some of said oil above the upper peripheral edge of said orbiting scroll member;

a thrust surface adjacent said orbiting scroll member back surface;

seal means between said orbiting scroll member and said thrust surface for sealingly separating between respective portions of said plate portion back surface exposed to discharge pressure and suction pressure;

drive means for causing said orbiting scroll member to orbit relative to said fixed scroll member;

radial compliance means for creating a radial compli7 ance force to bias said fixed scroll member and said orbiting scroll member radially toward one another, said radial compliance means controlling the volume of oil from said oil chamber used to lubri7 cate said scroll members.

6. A method of wearing both the orbiting and fixed scroll wraps in a scroll compressor comprising:

a hermetically sealed housing including therein a discharge chamber at discharge pressure and a suction chamber at suction pressure;

a fixed scroll member in said housing including an involute fixed wrap element;

an orbiting scroll member in said housing including a plate portion having a face surface and a back surface, said face surface having an involute orbiting wrap element thereon intermeshed with said fixed wrap element, said orbiting scroll member plate portion having a flange extending radially beyond said orbiting wrap element, said flange including a upper peripheral edge;

a frame including a thrust surface adjacent said orbiting scroll member back surface, said flange being disposed radially outwardly of said thrust surface;

seal means between said orbiting scroll member and said thrust surface for sealingly separating between respective portions of said plate portion back surface exposed to discharge pressure and suction pressure, said seal thereby experiencing a differential pressure;

drive means for causing said orbiting scroll member to orbit relative to said fixed scroll member;

an oil chamber in which said orbiting scroll member flange orbits, said chamber being substantially at suction pressure;

the method comprising the steps of:

forming an oil pool of sufficient depth in said oil chamber to extend said oil pool above said upper peripheral edge of said orbiting scroll flange so that oil is supplied to said intermeshed scrolls to control leakage between said scrolls; and operating the compressor to run together said orbiting scroll wrap and said fixed scroll wrap in a manner that as said scroll wrap elements wear together, the internal oil rate within the compressor is reduced to an equilibrium rate.

7. The method of claim 6 further comprising the step of radially biasing said orbiting scroll wrap toward said fixed scroll wrap whereby the internal oil rate through the compressor is controlled.

8. The method of claim 6 further comprising the step of reducing the differential pressure across said seal whereby oil flow past said seal is reduced to an equilibrium rate.

9. The method of claim 6 comprising the step of reducing the differential pressure between said scroll wrap elements and said oil pool.

* * * * *